United States Patent [19]

Paquin

[11] Patent Number: 4,778,101

[45] Date of Patent: Oct. 18, 1988

[54] TWO-WAY ENVELOPE

[76] Inventor: Jean Paquin, 1500 de Maisonneuve Blvd East, Montreal, Canada

[21] Appl. No.: 25,183

[22] Filed: Mar. 12, 1987

[30] Foreign Application Priority Data

Oct. 9, 1986 [CA] Canada ..... 520175

[51] Int. Cl.[4] ..... B65D 27/06

[52] U.S. Cl. ..... 229/73; 229/71

[58] Field of Search ..... 229/73, 68 R, 70, 71

[56] References Cited

U.S. PATENT DOCUMENTS

| | | | |
|---|---|---|---|
| 2,984,403 | 5/1961 | David | 229/73 |
| 2,985,464 | 5/1961 | McFarland | 229/73 |
| 3,111,257 | 11/1963 | Peach | 229/73 |
| 3,802,618 | 1/1974 | Wiessner | 229/73 |
| 4,044,942 | 8/1977 | Sherwood | 229/73 |
| 4,445,635 | 5/1984 | Barr | 229/73 |
| 4,565,317 | 1/1986 | Kranz | 229/73 |
| 4,669,652 | 6/1987 | Sequin | 229/73 |

*Primary Examiner*—Willis Little

*Attorney, Agent, or Firm*—Robic, Robic & Ass.

[57] ABSTRACT

A two-way envelope especially designed for use by Public Utilities, credit companies, mail order retailers and similar companies which have to send statements, bills, advertising brochures and/or offers and want to receive back payments or orders from their clients or consommers by return of mail. The envelope is made of one piece and comprises a flat pocket for receiving at least one document to be mailed or mailed back, and a flap integrally extending the upper edge of the top surface of this pocket. This flap comprises a first portion identical in size to the bottom surface of the pocket, and a second portion smaller in size than the top surface of the pocket. A first folding line is provided onto the flap adjacent the pocket to allow this flap to be folded upon the pocket to close with the first portion of the flap extending flat on the bottom surface of the pocket. A second folding line is provided on the flap at the junction between the first and second portions thereof, to allow the second portion of the flap to be folded back over the top surface of the pocket after the first portion has been folded upon the bottom surface thereof. First and second adhesive strip are provided on the first portion of the flap close to the second portion, and on the second portion. First and second name-and-address placement are provided at suitable locations onto the pocket or flap to display the name and address of the addressee when the envelope is mailed in one way and subsequently is the other.

9 Claims, 5 Drawing Sheets

FIG. 10
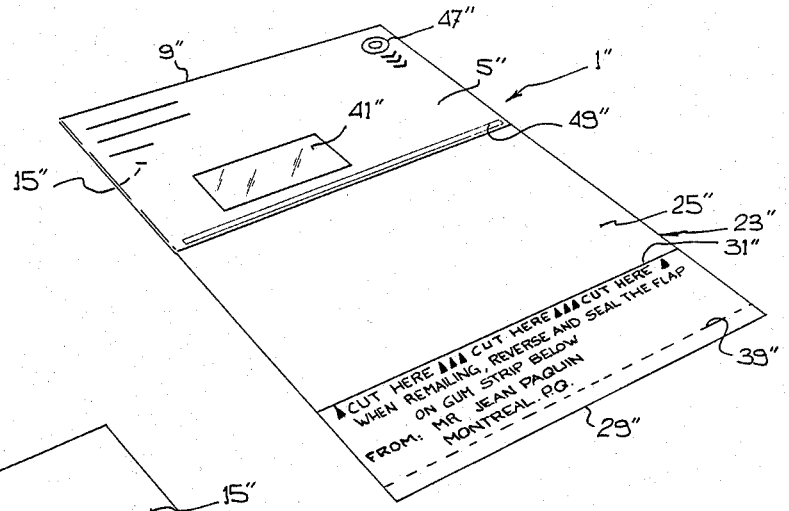
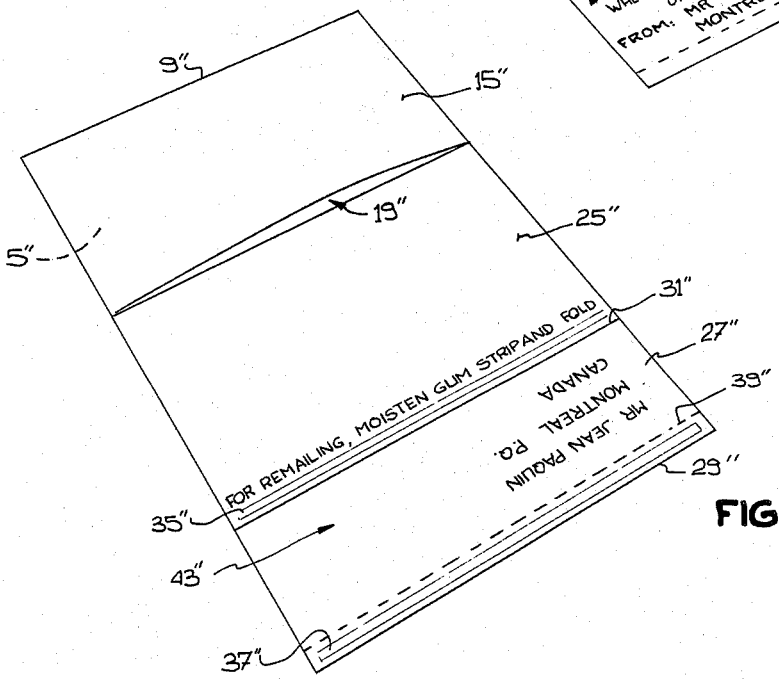
FIG. 11
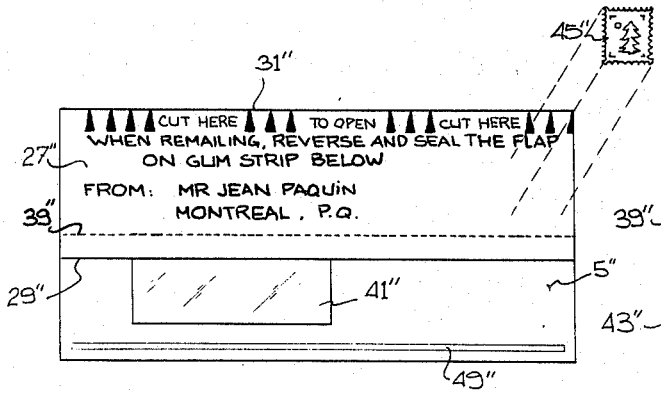
FIG. 12
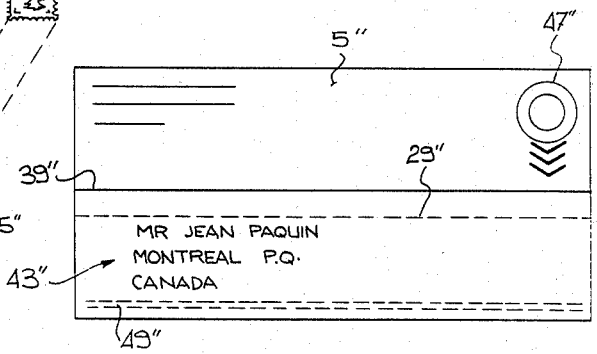
FIG. 13

TWO-WAY ENVELOPE

BACKGROUND OF THE INVENTION (a) Field of the Invention

The present invention is concerned with a two-way envelope especially designed for use by public utilities, credit companies, mail order retailers and similar companies which have to send statements, bills, advertising brochures and/or offers and want to receive back payments or orders from their clients or consummers by return of mail.

By "two-way" envelope, it is therefore meant an envelope which can be mailed from an original addressor to an addressee to transmit a document in one way, and can subsequently be mailed back or return from the addressee to the addressor in the other way.

(b) Brief Description of the Prior Art

Two-way envelopes are already known in the art and have already been made the subject matter of several patents including:

U.S. Pat. Nos.

1,635,278 of 1927
3,558,040 of 1971
3,802,618 of 1974
4,180,168 of 1979
4,288,028 of 1981
3,305,506 of 1981
4,354,631 of 1982
4,382,539 of 1983

A major problem with the known, two-way envelopes is that they are rather confusing to use, especially by the addressee or recipient. To overcome this major drawback, it has been suggested to print or type information on the envelope or on a separate notice. However, this is known to significantly increase the manufacturing cost.

Another problem of most of these known, two-way envelopes is that they are made of two or more pieces of paper that have to be glued onto each other, thereby making their manufacturing cost substantially high. For example, numerous envelopes comprise two flaps of different sizes that have to be glued onto the pocket-shaped portion of the envelope to successively work as closing and covering means to allow both sides of the envelope to play successively the roles of top and bottom sides.

U.S. Pat. No. 3,802,618 issued on April 9, 1974 in the name of Martin Gerald Wiessner discloses a two-way envelope comprising a flat pocket from which extends a flap formed with a central opening acting as a window. When the envelope is mailed in its one way, the flap is folded upon the pocket along a first folding line with the opening disclosing the appropriate directing and return addresses. On receipt of the envelope, a major part of the flap has to be removed and the remaining flap portion may be folded upon the pocket portion along a second folding line in such a manner as to leave exposed only the appropriate directing and return addresses for the return mailing.

This envelope structure is rather interesting in that the pocket of the envelope has to be printed on one side only. However, this structure has the following drawbacks.

First of all, the removable part of the flap which has to be torn away before mailing back the envelope, is merely a "mask" which is used for hidding the not-relevant information printed onto the top surface of the pocket when the envelope is mailed in its one way. Because both of the addressor and addressee's name and address have to be printed onto the top surface of the pocket, the addressee's name and address cannot be positioned at the usual place on top of the envelope, thereby making its handling by the Postal authorities rather difficult.

A second drawback is that the removable part of the flap is provided with a central opening which makes it easily subject to inadvertant tearing, especially when the mail is processed through automatic sorting machines.

A third drawback of this known envelope is that its size when mailed in the one way is different from its size when mailed back on the other way. It is indeed obvious from its structure that the removable portion of the flap is sized to cover both the pocket and the remaining portion of the same flap for mailing in the one way. When the envelope is mailed back in the other way, the remaining flap portion which originally extended in the same plane as the pocket and was covered together with the pocket with the removable portion of the flat, has to be folded upon the pocket, thereby reducing the size of the envelope.

SUMMARY OF THE INVENTION

The object of the invention is to provide a two way envelope designed for being mailed from an original addressor to an original addressee and subsequently mailed back from said addressee to said addressor, which envelope overcomes each of the above mentioned drawbacks, including those specific to the envelope disclosed and claimed in U.S. Pat. No. 3,802,618.

More particularly, the object of the present invention is to provide two-way envelope which is made of one piece and is thus very simple in structure thereby making it easy to manufacture at a reasonable cost, and which, due to its structure, is very simple to use by all the interested persons including the addressor, the Postal Authority in charge of sorting and delivering it, and the addressee.

The two-way envelope according to the invention is made of one piece and basically comprises a flat pocket for receiving at least one document to be mailed or mailed back such as a bill, a statement or some advertising brochures.

The pocket comprises a rectangular top surface and a rectangular bottom surface of substantially the same shape and size, which are each provided with a longitudinal upper edge, a longitudinal lower edge and a pair of lateral edges. The top and bottom surfaces of the pocket are connected to each other by their respective lower and lateral edges and defined between their respective upper edges an opening into which the documents to be mailed or mailed back may be introduced or removed.

A flap integrally extends the upper edge of the top surface of the pocket. This flap has a first portion adjacent the top surface which is substantially identical in size to the bottom surface of the pocket. The flap also has a second portion integrally extending the first portion away from the pocket. This second portion is smaller in size than the top surface of the pocket and defines a free edge.

A first folding line is provided onto the flap adjacent to the upper edge of the top surface of the pocket to allow this flap to be folded upon the pocket to close its opening with the first portion of the flap extending flat on the bottom surface of the pocket.

A second folding line is provided on the flap at the junction between the first and second portions thereof, to allow said second portion of the flap to be folded back over the top surface of the pocket after the first portion has been folded upon the bottom surface thereof.

A first adhesive strip is provided on the first portion of the flap close to and along the second portion of said flap, said first adhesive strip being positioned onto said first portion so as to come into contact with the bottom surface of the pocket when the flap is folded thereupon.

A second adhesive strip is provided on the second portion of the flap close to and along the free edge of the second portion. This second adhesive strip is positioned onto this second portion so as to come into contact with the surface of the pocket when the flap is folded thereupon.

A first name and address placement area is provided on the top surface of the pocket close to the upper edge thereof, to display the name and address of the original addressee even when the second portion of the flat is folded over this top surface. A second name and address placement area is also provided on either the first or second portion of the flap so as to be or become visible when the envelope is to be returned to the original addressor in order to display thereon the name and address of the original addressor.

In use, the envelope according to the invention can be mailed from the original addressor to the original addressee by folding the first portion of the flap upon the bottom surface of the pocket after the same has been filled with the documents to be mailed. Subsequently, the second portion of the flat can be folded and glued with the second adhesive strip upon the top surface of the pocket. Since, this second portion is smaller in size that the top surface of the pocket, the first name and address placement area remains visible onto this top surface and can be used to display the name and address of the addressee. Then, a stamp can be put in the upper right corner of the envelope over the displayed name and address of the addressee, the stamp being thus positioned onto the second portion of the flap.

When the addressee receives the envelope, he or she can open it by cutting the flap along the second folding line, that is on top of the displayed name and address. This way of opening the envelope is the standard way. Then, the addressee only has to unfold the remaining first portion of the flap to have access to the opening of the pocket.

To return the same envelope to the original addressor, the first portion of the flap has to be folded back over the opening of the pocket after introduction of the documents to be returned. The first adhesive strip on the first portion of the flap must then be glued on the bottom surface of the pocket. Thereafter, the name and address of the original addressor may be added, if they are not printed yet, in the second name-and-address placement area provided onto the flap, and a stamp has to be put in upper right corner of the envelope over the displayed name and address of the original addressor to which the envelope is to be returned.

As can now be understood, the envelope is mailed in its one way with the name and address of the addressee on the top surface of the pocket and the stamp in the upper right corner of the second flap portion which has been folded over and glued to the top surface of the pocket. Depending on whether part of the second portion of the flap is designed to be cut away or folded back and glued onto the top surface of the pocket, the envelope is returned from the addressee to the addressor in the other way with the name and address of the original addressor and the stamp preprinted or put on the first portion of the flap which is folded upon the bottom surface of the pocket, or, alternatively, on the reverse side of the second portion of the flap and the top surface of the pocket, with the first portion of the flap which is folded upon the bottom surface of the pocket.

These particular locations of the name and address of the addressor and addressee and of the stamps in the one and the other ways substantially reduce the risk of confusion, especially by the Postal Authorities in charge of sorting and delivering the envelope. In addition, this allows the names and addresses of both the addressor and addressee to be printed or written in a normal and standard place.

BRIEF DESCRIPTION OF THE DRAWINGS

The invention and its advantages will be better understood upon reading of the following non-restrictive description of two preferred embodiments thereof, with reference to the accompanying drawings in which:

FIG. 10 is a top respective view of a two-way envelope according to a third embodiment of the invention, which envelope is shown in fully opened position;

FIG. 11 is a bottom perspective view of the envelope shown in FIG. 10, in fully opened position;

FIG. 12 is a front elevational view of the top surface of the envelope of FIGS. 10 and 11 when mailed in its one way; and FIG. 13 is a front elevational view of the top surface of the envelope of FIGS. 10 and 11 when mailed back from the addresse to the original addressor.

DESCRIPTION OF TWO PREFERRED EMBODIMENTS

Figure 1:
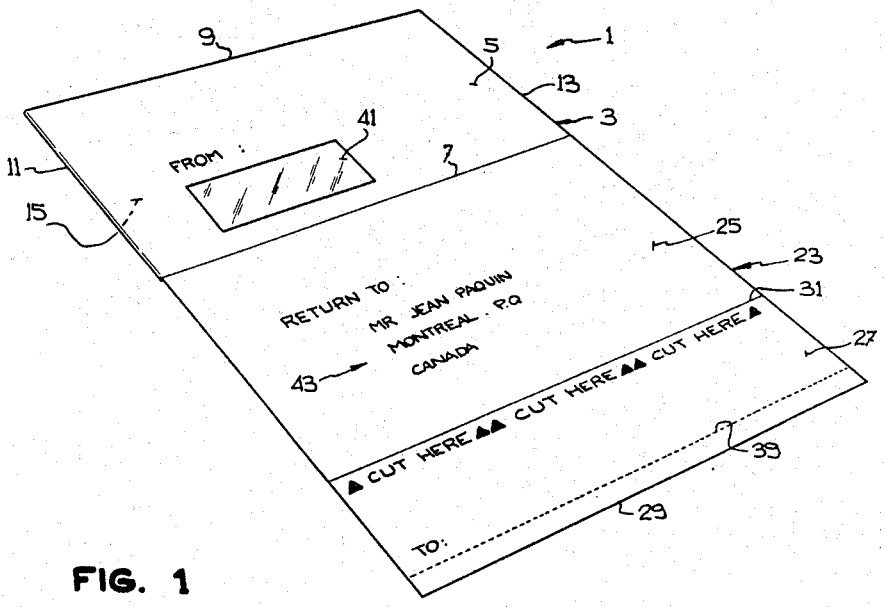
FIG. 1 is a top perspective view of a two-way envelope according to a first embodiment of the invention, which envelope is shown in fully opened position.

The two-way envelope 1 according to the invention as shown in FIGS. 1 to 5 is made of one single piece of suitable paper and comprises a flat pocket 3 formed and shaped in a conventional manner to receive at least one document to be mailed from an original addressor to an original addressee and to be mailed back from said addressee to said addressor. This document may be, for example, a bill, a statement, a letter or a mail offer.

The pocket 3 comprises a rectangular top surface 5 provided with a longitudinal upper edge 7, a longitudinal lower edge 9 and a pair of lateral edges 11 and 13. The pocket also comprises a rectangular bottom surface 15 having substantially the same shape and size as the top surface 5, which bottom surface is connected by its edges to the lower and lateral edges 9, 11 and 13 of the top surface 5 to define therewith the pocket 1. This particular connection of the bottom surface 15 of the pocket to the top surface 5 thereof can be made in any conventional manner and will not be described hereinafter. As better shown in FIG. 2, the non connected upper edges 7 and 17 of the top and bottom surfaces 5 and 15 of the pocket 3 together define a longitudinal opening 19 through the documents to be mailed or mailed back may be introduced into the pocket or removed therefrom.

As shown in the drawings, the envelope 1 also comprises a large flap 23 integrally extending the upper edge 7 of the top surface 5 of the pocket 3. The flap 23 comprises a first portion 25 adjacent the top surface 5 of the pocket. This first portion 25 of the flap 23 is substantially identical in size to the bottom surface 15 of the pocket. In other words, the first portion 25 of the flap is of the same length and of substantially the same height as the bottom surface 15 of the pocket 3. The flap 23 also comprises a second portion 27 integrally extending the edge of the first portion 25 opposite to the pocket 3. This second portion 27 of the flap 23 is smaller in size than the top surface 5 of the pocket 3. By "smaller in size", it is meant here that the second portion 27 of the flap 23 is of the same length as the pocket 3 but of smaller height than the top surface 5 thereof. The second portion 27 of the flap 23 which extends away from the first portion 25, ends at 29, thereby defining a free edge.

A first folding line is provided onto the flap 23 to allow this flap to be folded upon the pocket 3 to close its opening 19 with the first portion 25 of the flap extending flat on the bottom surface 15 of the pocket. To allow such a folding the first folding line must of course be adjacent to the upper edge 7 of the top surface 5 of the pocket. In the very particular embodiment shown in FIGS. 1 to 5, this first folding line is defined by the upper edge 7 of the top surface of the pocket.

A second folding line 31 is provided on the flap 23 at the junction between the first and second portions 25 and 27 of this flap to allow the second portion of the flap 23 to be folded back over the top surface 5 of the pocket 3 after the first portion 25 has been folded upon the bottom surface 15 of the pocket.

Figure 2:
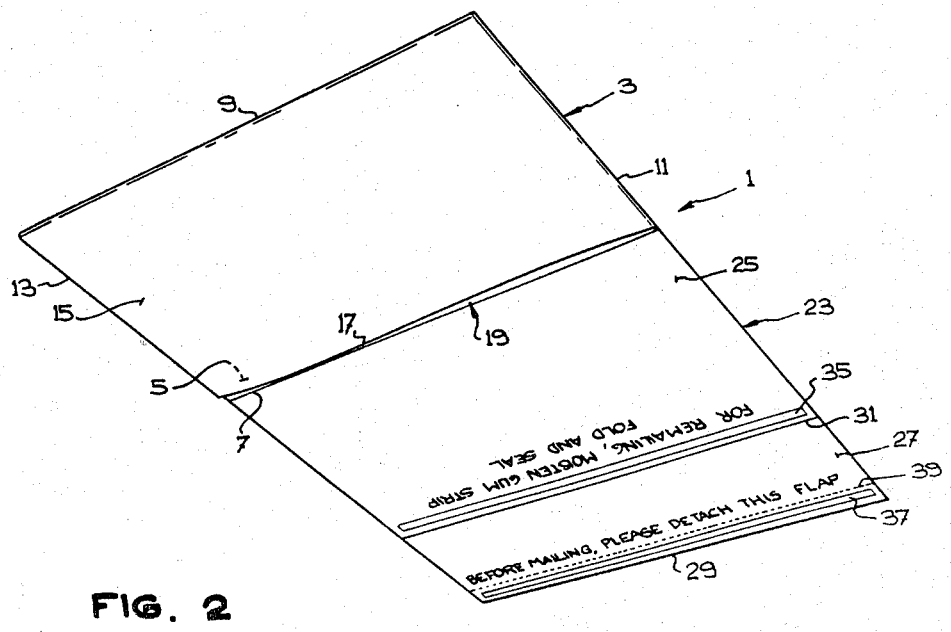
FIG. 2 is a bottom perspective view of the envelope shown in FIG. 1, in fully opened position.

As better shown in FIG. 2, a first adhesive strip 35 is provided on the first portion 25 of the flap close to and along the second portion 27 of this flap. This first adhesive strip 35 is positioned onto this portion 25 of the flap so as to come into contact with the bottom surface 15 of the pocket when the flap is folded thereupon. This means in practice that the first adhesive strip 35 is provided on the back of the flap 23.

A second adhesive strip 37 is also provided on the second portion 27 of the flap close to and along its free edge 29 so as to come into contact with the top surface 5 of the pocket 3 when the flap 23 is folded thereupon. This also means in practice that this second adhesive strip 37 is provided on the back of the flap 23, that is on the same side of this flap as the first adhesive strip 35. It is noteworthy that this particular feature makes the manufacture of the envelope very easy.

A first name-and-address placement area 41 is provided upside down on the top surface 5 of the pocket close to the upper edge 7 of this surface. This first name-and-address placement area 41 advantageously consists of a window provided in the top surface 5, which window is closed by a piece of transparent material through which can be read the name and address of the addressee printed onto one of the documents inserted by the addressor into the pocket 3 prior to mailing it.

A second name-and-address placement area 43 is provided on top of the first portion 25 of the flap so as to be visible when this first portion 25 of the flap 23 is folded upon the pocket 3. This second name-and-address placement area 43 may consist of a blank space to be filled up by the user of the envelope. More generally however, this second name and address placement area will be preprinted with the name and address of the original addressor of the envelope, to whom the envelope has to be returned by the addressee after receipt.

Advantageously, the envelope 1 may comprise instructions and information printed on both sides of its flap 23 and pocket 3, these instructions and/or information being mainly directed to the original addressee to help him or her in properly opening and subsequently returning the envelope to the addressor. An example of suitable instructions that can be printed onto the flap and pocket of the envelope, is given in the accompanying drawings.

In the particular embodiment shown in FIGS. 1 to 5, the envelope finally comprises a tearing line 39 extending close to and along the second adhesive strip 37 to allow easy detachment of the part of the second portion 27 of said flap 23 which is not glued onto the top surface 5 of the pocket by means of this second adhesive 37. The necessity of such detachment will be better understood hereinafter.

The envelope 1 disclosed hereinabove can be used as follows.

To mail the envelope in its one way from the original addressor to the original addressee, the documents to be mailed have first to be introduced into the pocket 3 in such a manner that the name and address of the addressee which are printed onto at least one of the documents to be mailed, be located just under the window 41 provided in the top surface 5 of the pocket to be visible therethrough. Then, the first portion 25 of the flap 23 is folded upon the bottom surface 15 of the pocket 3. When this is done, the second portion 27 is in turn folded back upon the top surface of the pocket and glued thereon with the second adhesive strip 37.

Figure 3:
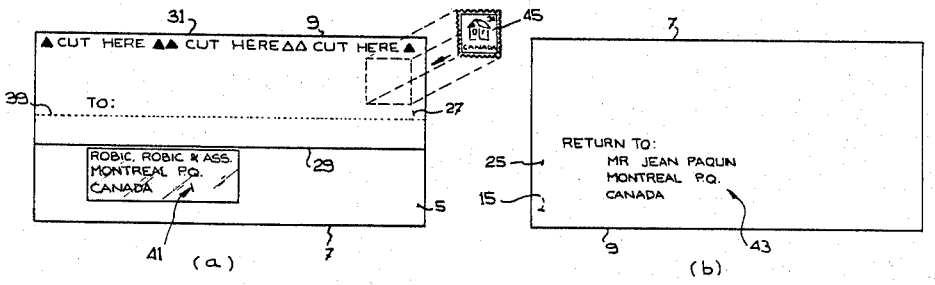
FIGS. 3(*a*) and (*b*) are front elevational views of the top and bottom surfaces of the envelope of FIGS. 1 and 2, when mailed on its one way.

Since the second portion 27 of the flap 23 is smaller in size than the top surface 5 of the pocket, the window 41 through which the name and address of the addressee is visible remains uncovered, as shown in FIG. 3(*a*). If desired, the word "To" can be printed onto the second portion 27 of the flap so as to be located just above the tearing line 39 above the window 41 when the envelope 1 is closed, as shown in FIG. 3(*a*), to make it clear that the envelope is to be mailed to the addressee in this one way.

Mailing of the envelope in its one way is achieved by putting a stamp 45 in the upper right corner of the envelope on the one side thereof where are displayed the name and address of the addressee through the window 41. As can be seen in FIG. 3(*a*), the stamp 45 is thus positioned onto the second portion 27 of the flap.

As shown in FIG. 3(*b*), the external side of the first portion 25 of the flap 23 which is folded upon the bottom surface 15 of the pocket may be preprinted with the name and address of the addressor at 43. To make it clear that this name and address is the one of the addressor, the expression "return to" may be printed just over the second name and address placement area 43.

Figure 4:
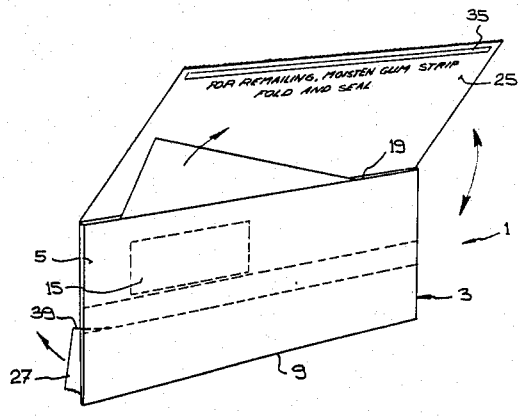
FIG. 4 is a perspective view of the envelope of FIGS. 1 and 2, during its opening by the addressee.

The envelope 1 when delivered to the addressee, can be easily opened by cutting the flap 23 along its second folding line 31, that is on top of the name and address of the addressee as displayed through the window 41. To make this step clearer, the upper edge of the second portion 27 of the flap adjacent the second folding line 31 can be printed with the words "cut here" as shown in FIG. 3(*a*). After such a cutting is made, the first portion 25 of the flap may be opened as shown in FIG. 4 to give access to the opening 19 of the pocket in order to remove therefrom its content.

Subsequently, the addressee may return the same envelope 1 back to the original addressor by folding back the first portion 25 of the flap over the opening 19 of the pocket 3 after having introduced into the pocket the document and/or check to be returned. Then, closing of the envelope is made by gluing the first adhesive strip 35 located on the first portion 25 of the flap directly onto the bottom surface 15 of the pocket 3 along the lower edge 9. To make these steps easy to understand, the expression "for remailing, moisten gum strip, fold and seal" may be printed just under the second adhesive strip 35 on the back of the first portion 25 of the flap as shown in FIG. 4.

If necessary, the name and address of the original addressor has to be written in the second name and address placement area 43. In most of the cases however, this will not be necessary if the name and address of the original addressor is preprinted as explained hereinabove.

Figure 5:
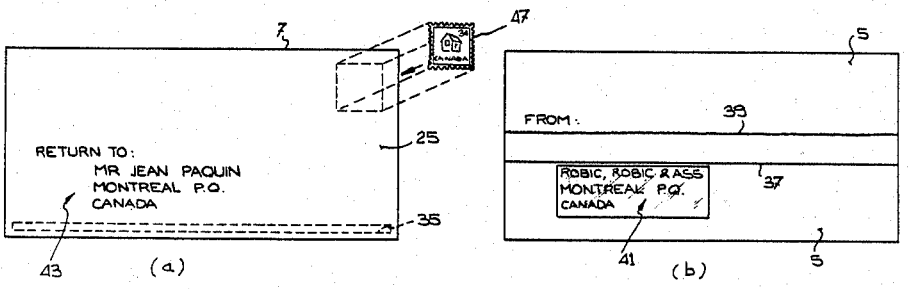
FIGS. 5(*a*) and (*b*) are front elevational views of the bottom and top surfaces of the envelope of FIG. 1, when the envelope is mailed back from the addressee to the original addressor.

Then, the second portion 27 of the flap glued on the top surface 5 with the stamp 45 used when mailing the envelope in its one way, must be torn out along the tearing line 39 extending close to and along the second adhesive strip 37, to "change" the original front side of the envelope into a back side. To make it clear that this side has become the back side of the envelope when it is mailed back to the addressor, the word "from" may be printed onto the previously hidden part of the top surface 5 of the pocket, just above the tearing line 39 as shown in FIG. 5(*b*), slightly above the window 41 which displays the name and address of the original addressee which is now the addressor. Mailing of the so modified envelope can be made after having put a new stamp 47 in the upper right corner of the envelope over the displayed name and address of the original addressor, as shown in FIG. 5(*a*). As can be seen, the stamp 47 is thus positioned onto the first portion of the flap adjacent to the first folding line 7.

Figure 6:
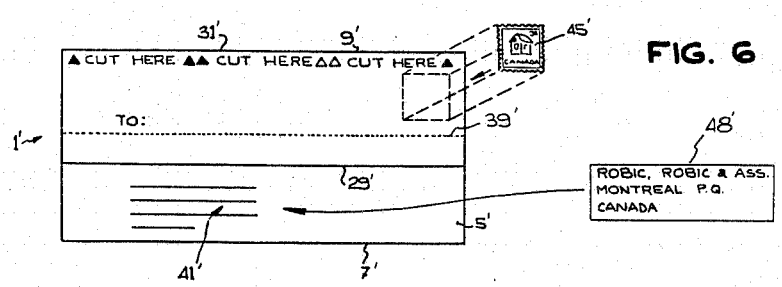
FIG. 6 is a front elevational view of the top surface of a variant of the envelope shown in FIGS. 1 and 2, when this envelope is mailed from the addressor to the addressee.

FIG. 6 of the drawings shows a variant of the envelope 1 shown in FIGS. 1 to 5. Since the envelope 1' shown in this figure is merely a variant of the envelope 1 shown in the previous figures, the same reference numerals have been used to identify the same elements, with a distinguishing prime (').

As can be seen in FIG. 6, the only difference between the envelope 1' and the envelope 1 is that the first name-and-address placement area 41' of the envelope 1' does not comprise a window but merely a few preprinted, horizontal lines over which the name and address of the original addressee may be written or typed. Alternatively, a sticker 48' on which the name and address of the addressee is printed on it may be glued onto the area 41'.

Figure 7:
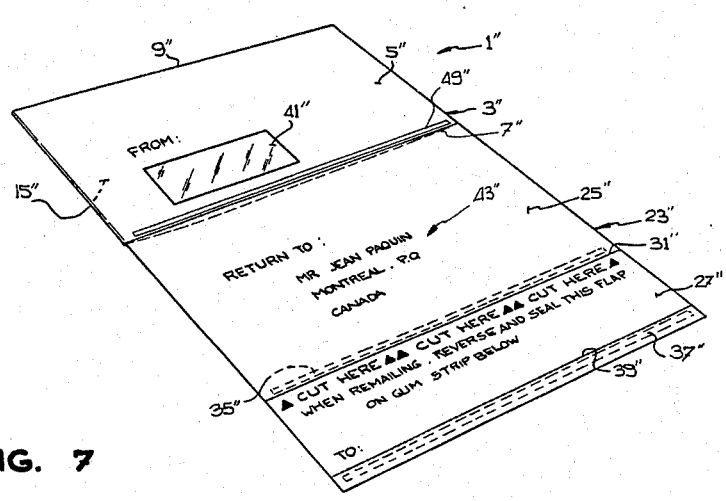
FIG. 7 is a top perspective view of a two-way envelope according to a second embodiment of the invention, which envelope is shown in fully opened position.
Figure 8:
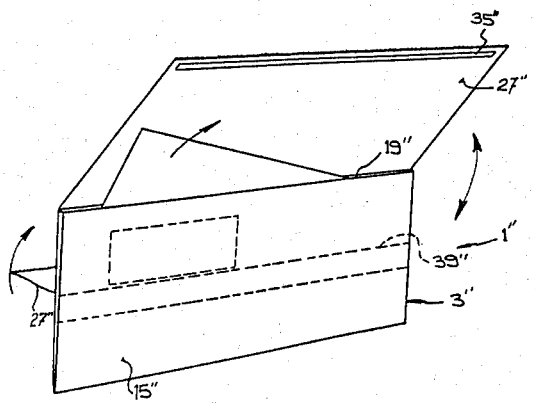
FIG. 8 is a perspective view of the envelope of FIG. 7, when the same is opened by the addressee.
Figure 9:
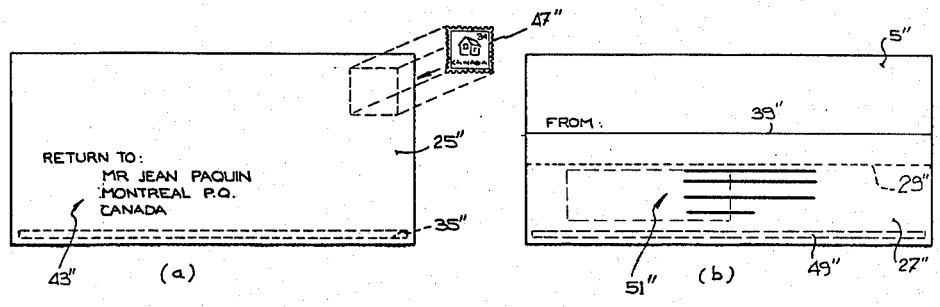
FIGS. 9(*a*) and (*b*) are front elevational views of the bottom and top surfaces of the envelope of FIG. 7, when mailed back from the addressee to the original addressor.

FIGS. 7 to 9 show second embodiment of the invention. Since the envelope 1'' according to this second embodiment is very close in structure to the envelope 1 previously described in connection with FIGS. 1 to 5, the same reference numerals, have been used to identify the same elements, with a distinguishing second indicia ('').

As can be seen in FIG. 7, the envelope 1'' according to this second embodiment basically distinguishes from the envelope 1 previously described, in that it comprises a third folding line 39'' in replacement of the tearing line 39 of the envelope 1. The third folding line 39'' extends close to and along the second adhesive strip 37'' of the second portion 27'' of the flap to allow most of the second portion of the flap that was cut away from the first portion when the envelope was opened, to be subsequently folded back on the bottom part of the top surface 5'' of the pocket. As shown with an arrow in FIG. 8, such a folding causes the stamp (not shown) originally put by the addressor, and the first name and address placement area 41 located on the top surface 5'' of the pocket to be completely hidden (see the dotted line in FIG. 9(*b*)).

To keep in place the second portion 27'' of the flap 23'' folded back upon the bottom part of the top surface of pocket a third adhesive strip 49'' is provided on this top surface 5'' of the pocket, as shown in FIG. 7. This third adhesive strip 49'' is used to glue the portion 27'' in hidding position after said portion has been folded back along the third folding line 39''.

As can be seen, the only difference between this envelope 1'' and the envelope 1 is that the second portion 27'' of the flap has not to be torn away before mailing back the envelope, but rather folded back upwardly to hide the first name and address placement area 41'' and the original stamp 45'' put by the original addressor. If desired, a third name and address placement area 51'' can be provided on the back side of the second portion 27'' of the flap to indicate the name and address of the person mailing back the envelope to the original addressor.

FIGS. 10 to 13 show a third embodiment of the invention, which, in fact, amounts to a variant of the second embodiment described here in above in connection with FIGS. 7 to 9. For this reason, the same references numerals with their distinsguishing second indicia have been used in these FIGS. 10 to 13 to identify the same structural elements.

As the envelope shown in FIGS. 7 to 9, the envelope 1'' according to this third embodiment comprises a third folding line 39'' to allow most of the second portion 27'' of the flap 23'', when second portion is cut away from the first portion 25'', when the envelope is opened, to be subsequently folded back on the bottom part of the top surface 5'' of the pocket.

Similarly, the envelope 1'' according to the third embodiment comprises a third adhesive strip 49'' provided on the top surface 5'' of the pocket, as shown in FIGS. 10 and 12, to glue the second portion 27'' in hidding position after it has been folded back above the third folding line 39''.

As can been seen, the only difference between the envelope 1'' shown in FIGS. 7 to 9 and the one shown in FIGS. 10 to 13 is in the location of the second name-and-address placement area 43'' which, instead of being provided on the external side of the first portion 25'' of the flap 23'' (see FIGS. 7 and 9(*a*)) is provide up side down on the back side of the second portion 27'' of the flap 23'' (as shown in FIGS. 11 and 13), to become visible when this second portion 27'' is folded back onto the top surface 5'' of the pocket and glued with the strip 49'' prior the being mailed back mailed back (returned) to the original addressor.

This particular embodiment is particularly interesting in that it allows preprinting of a stamp 47'' onto the top surface 5'' of the pocket, at a location where it is hidden by the second portion 27'' when the envelope is mailed to the original addressee in its one way (see FIG. 10). This third embodiment is also interesting in that the visible side of the first flap 25'' is and remains blank, thereby reducing to zerò the risk of an error by those in charge of sorting the envelope 1'' when it is mailed in its one or other way.

As can now be appreciated, the envelope according to the invention is very simple in structure and very easy to use. It is also very efficient and not confusing at all for either the addressor, the addressee and/or the postal authorities in charge of sorting and delivering it in its both ways.

The present invention is not to be construed as limited to the particular embodiments disclosed hereinabove. It is indeed to be understood that the invention may be practized otherwise than as specifically described hereinabove within the scope of the accompanying claims.

I claim:

1. A two-way envelope designed for being mailed from an original addressor to an original addressee and subsequently mailed back from said addressee to said addressor, said envelope being made of one piece and comprising:

a flat pocket for receiving at least one document to be mailed or mailed back, said pocket comprising a rectangular top surface and a rectangular bottom surface of substantially the same shape and size, said top and bottom surfaces being each provided with a longitudinal upper edge, a longitudinal lower edge and a pair of lateral edges and being connected to each other by their respective lower and lateral edges to define between their respective upper edge an opening through which at least one document to be maieor mailed back may be introduced or removed;

a flap integrally extending the upper edge of the top surface of the pocket, said flap having a first portion adjacent said top surface, said first portion being substantially identical in size to the bottom surface of the pocket, and a second portion integrally extending the first portion away from the pocket, said second portion being smaller in size than the top surface of the pocket and having a free edge;

a first folding line provided onto the flap adjacent the upper edge of the top surface of the pocket to allow said flap to be folded upon the pocket to close its opening with the first portion of said flap extending flat on the bottom surface of the pocket;

a second folding line provided on the flap at the junction between the first and second portions thereof said second folding line allowing the second portion of the flap to be folded back over the top surface of the pocket after the first portion has been folded upon the bottom surface thereof;

a first adhesive strip provided on the first portion of the flap close to and along the second portion of said flap, said first adhesive strip being positioned onto said second portion so as to come into contact with the bottom surface of the pocket when the flap is folded thereupon;

a second adhesive strip provided on the second portion of the flap close to and along the free edge of said second portion, said second adhesive strip being positioned onto said second portion so as to come into contact with the top surface of the pocket when the flap is folded thereupon; and a first name-and-address placement area provided on the top surface of the pocket close to the upper edge thereof, to display the name and address of the original addressee even when the second portion of the flap is folded over said top surface;

whereby in use:

(a) mailing of the envelope by the original addressor to the original addressee is made by:

folding the first portion of the flap upon the bottom surface of the pocket after the same has been filed with the at least one document to be mailed;

subsequently folding and gluing with the second adhesive strip the second portion of the flap back upon the top surface of the pocket, the first name-and-address placement area remaining visible onto said top surface and being used to display the name and address of the addressee, and when putting a stamp in the upper right corner of the envelope over the displayed name and address of the addresses, the stamp being thus positioned onto the second portion of the flap;

(b) opening of the envelope by the addressee is made by:

cutting the flap along the second folding line, that is on top of the displayed name and address of the addressee, and then unfolding the remaining first portion of the flap to have access to the opening of the pocket; and (c) retun of the same envelope from the addressee back to the original addressor is made by:

folding back the first portion of the flap over the opening of the pocket after having introduced the document to be returned;

gluing the first adhesive strip of the first portion to the bottom surface of the pocket;

adding the name and address of the original addressor in a second name-and address placement area provided onto the first portion of the flap if said name and address of the original addressor are not preprinted, and putting a stamp in the upper right corner of the envelope over the displayed name and address of the original addressor to which the envelope is to be returned, wherein the second name-and-address placement area is provided on the first portion of the flap so as to be visible when said first portion is folded upon the pocket and wherein said envelope further comprises:

a third folding line extending close to and along the second adhesive strip to allow most of the second portion of the flap that was cut away from the first portion when the envelope was opened, to be folded back upon the bottom part of the top surface of the pocket, such a folding causing the first name-and-address placement area on said top surface of the pocket to be completely hidden; and a third adhesive strip provided on the top surface of the pocket for use to glue in hidding position the second portion of the flap after the same has been folded back along the third folding line.

2. The two-way envelope of claim 1, wherein the name and address of the original addressor is preprinted in the second name-and-address placement area prior to mailing the envelope.

3. The two-way envelope of claim 2, further comprising:

instructions printed on the flap and pocket of the envelope, said instructions being directed to the original addressee to help him in properly opening and subsequently returning the envelope.

4. The two-way envelope of claim 3, wherein the first name-and-address placement area comprises a window provided in the top surface of the pocket, through which can be read the name and address of the addressee, said name and address being printed on said at least one document to be mailed.

5. A two-way envelope designed for being mailed from an original addressor to an original addressee and subsequently mailed back from said addressee to said addressor, said envelope being made of one piece and comprising:

a flat pocket for receiving at least one document to be mailed or mailed back, said pocket comprising a rectangular top surface and a rectangular bottom surface of substantially the same shape and size, said top and bottom surfaces being each provided with a longitudinal upper edge, a longitudinal lower edge and a pair of lateral edges and being connected to each other by their respective lower and lateral edges to define between their respective upper edges an opening through which the at least one document to be mailed or mailed back may be introduced or removed;

a flap integrally extending the upper edge of the top surface of the pocket, said flap having a first portion adjacent said top surface, said first portion being substantially identical in size to the bottom surface of the pocket, and a second portion integrally extending the fist portion away from the pocket, said second portion being smaller in size than the top surface of the pocket and having a free edge;

a first folding line provided onto the flap adjacent the upper edge of the top surface of the pocket to allow said flap to be folded upon the pocket to close its opening with the first portion of said flap extending flat on the bottom surface of the pocket;

a second folding line provided on the flap at the junction between the first and second portions thereof, said second folding line allowing the second portion of the flap to be folded back over the top surface of the pocket after the first portion has been folded upon the bottom surface thereof;

a first adhesive strip provided on the first portion of the flap close to and along the second portion of said flap, said first adhesive strip being positioned onto said first portion so as to come into contact with the bottom surface of the pocket when the flap is folded thereupon;

a second adhesive strip provided on the second portion of the flap close to and along the free edge of said second portion, said second adhesive strip being positioned onto said second portion so as to come into contact with the top surface of the pocket when the flap is folded thereupon; and a first name-and-address placement area provided on the top surface of the pocket close to the upper edge thereof, to display the name and address of the original addressee even when the second portion of the flap is folded over said top surface;

whereby in use:

(a) mailing of the envelope by the original addressor to the original addressee is made by:

folding the first portion of the flap upon the bottom surface of the pocket after the same has been filled with the the at least one document to be mailed;

subsequently folding and gluing with the second adhesive strip the second portion of the flap back upon the top surface of the pocket, the first name-and-address placement area remaining visible onto said top surface and being used to display the name and adress of the addressee, and then putting a stamp in the upper right corner of the envelope over the displayed name and address of the addressee, the stamp being thus positioned onto the second portion of the flap;

(b) opening of the envelope by the addressee is made by:

cutting the flap along the second folding line, that is on top of the displayed name and address of the addressee, and then unfolding the remaining first portion of the flap to have access to the opening of the pocket; and (c) return of the same envelope from the addressee back to the original adressor is made by:

folding back the first portion of the flap over the opening of the pocket after having introduced the document to be returned;

gluing the first adhesive strip of the first portion to the bottom surface of the pocket;

adding the name and address of the original addressor in a second name-and-address placement area provided onto the first portion of the flap if said name and address of the original addressor are not preprinted, and putting a stamp in the upper right corner of the envelope over the displayed name and address of the original addressor to which the envelope is to be returned;

wherein the second name-and-address placement area is provided onto the second portion the flap so as to be invisible when said second portion is folded back over the top surface of the pocket and the envelope mailed from the original addressor to the original addressee, and wherein said envelope further comprises:

a third folding line extending close to and along the second adhesive strip to allow most of the second portion of the flap that was cut away from the first portion when the envelope was opened, to be folded back upon the bottom part of the top surface of the pocket, such a folding causing the stamp put by the addressor and the first name-and-adress placement area on said top surface of the pocket to be completely hidden, and, simultaneously, the second name-and-address placement area to be discovered and substituted for the first placement area; and a third adhesive strip provided on the top surface of the pocket for use to glue in hidding position the second portion of the flap after the same has been folded back along the third folding line.

6. The two-way envelope of claim 5, wherein the name and address of the original addressor is preprinted in the second name-and-address placement area prior to mailing the envelope.

7. The two-way envelope of claim 6, further comprising:

instructions printed on the flap and pocket of the envelope, said instructions being directed to the original addressee to help him in properly opening and subsequently returning the envelope.

8. The two-way envelope of claim 7, wherein the first name-and-address placement area comprises a window provided in the top surface of the pocket, through which can be read the name and address of the addressee, said name and address being printed on said at least one document to be mailed.

9. The two-way envelope of claim 7, wherein a preprinted stamp is preprinted onto the top surface of the pocket at a location where it is hidden by the second flap when the envelope is mailed by the original addressor to the original addressee but discovried when said second flap gas been cut out and folded back to hide the first name-and-address placement area.

* * * * *

UNITED STATES PATENT AND TRADEMARK OFFICE

CERTIFICATE OF CORRECTION

PATENT NO. : 4,778,101

DATED : October 18, 1988

INVENTOR(S) : Jean PAQUIN

It is certified that error appears in the above-identified patent and that said Letters Patent is hereby corrected as shown below:

IN THE SPECIFICATION:

column 8, line 65: delete the word "away";

column 9, line 17: delete the expression "mailed back" at second occurrence;

IN THE CLAIMS:

column 9, line 58: delete the word "maieor" and substitute therefor the expression --mailed or--;

column 10, line 44: delete the word "addresses" and substitute therefor the word --address--;

column 11, line 8: delete the word "away";

UNITED STATES PATENT AND TRADEMARK OFFICE

CERTIFICATE OF CORRECTION

PATENT NO. : 4,778,101

DATED : October 18, 1988

INVENTOR(S) : Jean PAQUIN

It is certified that error appears in the above-identified patent and that said Letters Patent is hereby corrected as shown below:

column 12, line 25: delete the article "the" at second occurrence;

line 68: delete the word "away";

column 14, line 17: delete the word "discovried" and substitute therefor the word --discoveried--;

line 18: delete the word "gas" and sustitute therefor the verb --has--; and delete the word "out".

Signed and Sealed this

Fourteenth Day of March, 1989

*Attest:*

*Attesting Officer*

DONALD J. QUIGG

*Commissioner of Patents and Trademarks*